US011873639B2

(12) United States Patent
Yin et al.

(10) Patent No.: US 11,873,639 B2
(45) Date of Patent: Jan. 16, 2024

(54) BEAM-COLUMN JOINT STRUCTURE

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Jhih-Syuan Chen, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 129 days.

(21) Appl. No.: 17/563,138

(22) Filed: Dec. 28, 2021

(65) Prior Publication Data

US 2022/0220720 A1 Jul. 14, 2022

(30) Foreign Application Priority Data

Jan. 8, 2021 (TW) ..... 110100761

(51) Int. Cl.
*E04B 1/30* (2006.01)

(52) U.S. Cl.
CPC ..... *E04B 1/30* (2013.01)

(58) Field of Classification Search
None
See application file for complete search history.

(56) References Cited

U.S. PATENT DOCUMENTS

| | | | | |
|---|---|---|---|---|
| 10,323,402 | B1 * | 6/2019 | Yin | E04C 5/01 |
| 2004/0231278 | A1 * | 11/2004 | Yin | E04C 5/0609 52/649.4 |
| 2019/0226206 | A1 * | 7/2019 | Yin | E04B 1/215 |
| 2022/0220720 | A1 * | 7/2022 | Yin | E04B 1/2403 |

FOREIGN PATENT DOCUMENTS

| | | | | |
|---|---|---|---|---|
| BE | 1012779 | A6 * | 3/2001 | E04B 1/24 |
| JP | H07207755 | A * | 8/1995 | |
| JP | 2706431 | B2 * | 1/1998 | |
| TW | M565222 | U | 8/2018 | |
| WO | 2018056437 | A1 | 3/2018 | |

OTHER PUBLICATIONS

Taiwan Office Action and Search Report dated Jun. 8, 2021, in counterpart Taiwan application 110100761, 5 pages in Chinese.

* cited by examiner

*Primary Examiner* — Joshua K Ihezie
(74) *Attorney, Agent, or Firm* — Juan Carlos A. Marquez; Marquez IP Law Office, PLLC

(57) ABSTRACT

A beam-column joint structure is provided. The beam-column joint structure comprises: a hollow rectangular steel frame consisting of a first sidewall, a second sidewall, a third sidewall and a fourth sidewall and a plurality of H-beams, each of the H-beams being fixedly attached to an outer surface of at least some of these sidewalls. Some of the H-beams may be eccentric with respect to the sidewalls to which they are attached.

12 Claims, 13 Drawing Sheets

BEAM-COLUMN JOINT STRUCTURE

FIELD OF THE INVENTION

The instant disclosure relates to a beam-column joint structure, in particular to a beam-column joint structure for a precast concrete column and steel beams.

BACKGROUND

Conventional methods of constructing reinforced concrete (RC) buildings are conducted floor-by-floor from bottom to top, which is time consuming. Such conventional method involves many processes, such as tying the reinforced steel bars, molding, grouting and so on, which requires a great number of workers on the construction site. Thus, the quality of construction is highly dependent on factors such as weather and the skill and experience of the workers, and is difficult to control.

Using steel reinforced concrete (SRC) for load-bearing beams and columns may expedite the construction process. However, extensive use of SRC will require a great amount of steel, resulting in high construction costs.

To resolve the above problems, a composite construction including precast RC columns and steel beams is provided. For example, precast RC columns are first fabricated in the factory, and then transported to the construction site to be hoisted and assembled with steel beams.

However, some foundations for such conventional constructions are irregular in shape, making it impossible to align the central lines of the beams with the center lines of the precast RC columns located near the boundaries of the irregular foundations. Installation of such eccentric steel beams onto precast RC columns is difficult and time-consuming. Therefore, it is desirable to provide a beam-column joint structure that can be used for rapidly assembling a precast RC column with such eccentric steel beams.

SUMMARY OF THE INVENTION

According to one exemplary embodiment of the instant disclosure, a beam-column joint structure is provided which comprises: a hollow rectangular steel frame and a plurality of H-beams. The hollow rectangular steel frame consists of a first sidewall, a second sidewall, a third sidewall and a fourth sidewall, wherein the first sidewall is arranged opposed to the third sidewall, and the second sidewall is arranged opposed to the fourth sidewall. Each of the plurality of H-beams is fixedly attached to an outer surface of at least some of the first sidewall, the second sidewall, the third side wall and the fourth sidewall. A first axis is defined by the central position of the first sidewall and the central position of the third sidewall, and a second axis is defined by the central position of the second sidewall and the central position of the fourth sidewall.

For further understanding of the instant disclosure, the following embodiments are provided along with illustrations to facilitate appreciation of the instant disclosure; however, the appended drawings are merely provided for reference and illustration and are not intended to be used for limiting the scope of the instant disclosure.

BRIEF DESCRIPTION OF THE DRAWINGS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

DETAILED DESCRIPTION OF THE PREFERRED EMBODIMENTS

Figure 1A:
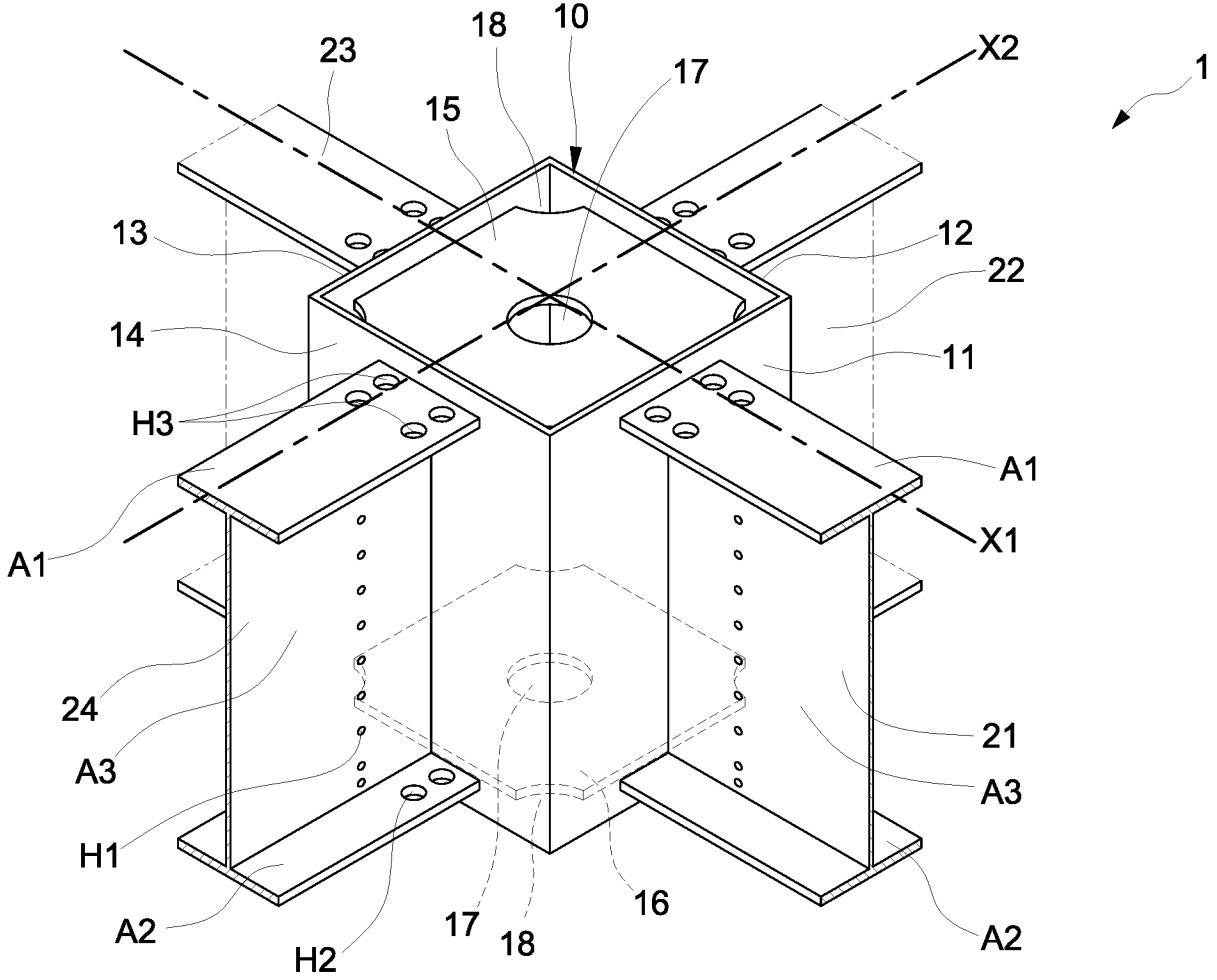
FIG. 1A is a perspective schematic view showing a beam-column joint structure in accordance with an embodiment of the instant disclosure.

In order to facilitate understanding of the technical features, technical contents, technical advantages and technical effects of the subject invention, a detailed description with accompanying drawings is provided below for explanation only. The drawings only serve an auxiliary purpose for understanding of the technical contents; the scope of the subject invention should not be interpreted merely based on the scale or the relative positions between the elements illustrated in the drawings.

The terminology used in the description of the present disclosure herein is for the purpose of describing particular embodiments only, and is not intended to be construed as a limitation of the invention. As used in the description of the invention and the appended claims, the singular articles "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As shown in FIG. 1A, a beam-column joint structure 1 is provided which comprises: a hollow rectangular steel frame 10, and a plurality of H-beams 21, 22, 23, 24. The hollow rectangular steel frame 10 consists of a first sidewall 11, a second sidewall 12, a third sidewall 13, and a fourth sidewall 141, wherein the first sidewall 11 is arranged opposed to the third sidewall 13, and the second sidewall 12 is arranged opposed to the fourth sidewall 14. Each of the plurality of H-beams 21, 22, 23, 24 is fixedly attached to an outer surface of at least some of the first sidewall 11, the second sidewall 12, the third side wall 13 and the fourth sidewall 14. A first axis X1 is defined by the central position of the first sidewall 11 and the central position of the third sidewall 13, and a second axis X2 is defined by the central position of the second sidewall 12 and the central position of the fourth sidewall 14.

Each of the plurality of H-beams 21, 22, 23, 24 is composed of a top flange A1, a bottom flange A2 and a web A3. In the embodiment as shown in FIG. 1A, each of the central axes along the lengthwise direction of the plurality of H-beams 21, 22, 23, 24 is aligned with the first axis X1 or the second axis X2 of the hollow rectangular steel frame 10. Consequently, H-beam 21 and H-beam 23 are symmetrically disposed with respect to the hollow rectangular steel frame 10, and H-beam 22 and H-beam 24 are symmetrically disposed with respect to the hollow rectangular steel frame 10.

Figure 1B:
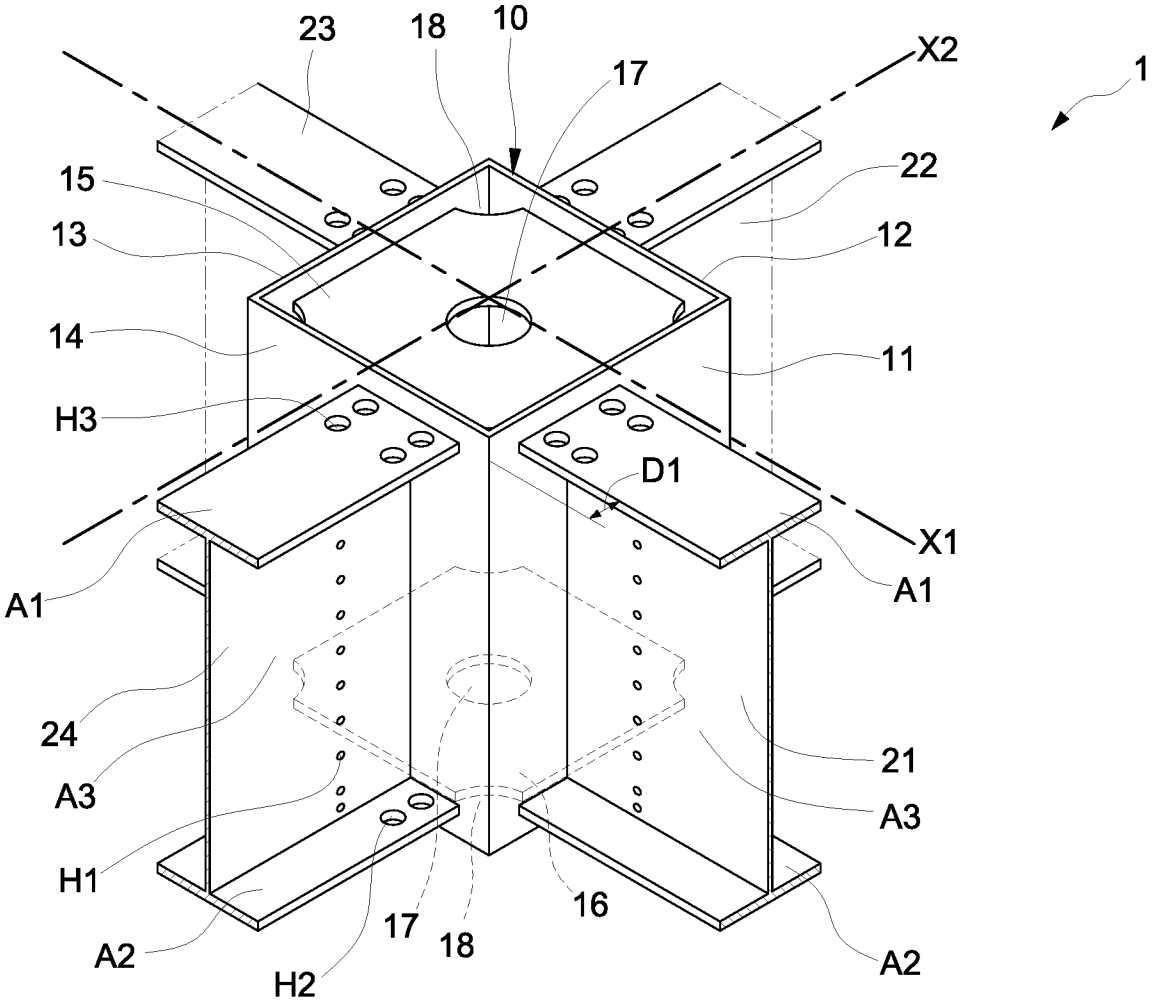
FIG. 1B is a perspective schematic view showing a beam-column joint structure in accordance with another embodiment of the instant disclosure.

In other embodiments of the instant disclosure, the central axis of an H-beam is not necessarily aligned with the first axis X1 or the second axis X2 of the hollow rectangular steel frame 10. For example, FIG. 1B illustrates another embodiment of the instant disclosure wherein each of the central axes along the lengthwise direction of the plurality of H-beams 21, 22, 23, 24 is not aligned with the first axis X1 or the second axis X2 of the hollow rectangular steel frame 10. Specifically, the central axis of H-beam 21 and that of H-beam 23 are offset from the first axis X1 in the transverse direction of the first sidewall 11 or the third sidewall 13. The central axis of H-beam 22 and that of H-beam 24 are offset from the second axis X2 in the transverse direction of the second sidewall 12 or the fourth sidewall 14. In addition, the distance D1 from the edge of the top flange A1 or the edge of the bottom flange A2 to an edge of the first sidewall 11 is more than 10 centimeters.

Based on the space provided for the construction and the required strength for the beam-column joint structure 1, an architect may decide whether the central axis of each H-beam should be aligned with the first axis X1 or the second axis X2 of the hollow rectangular steel frame 10, and if not, the architect needs to decide the offset distance between the central axes and the first axis X1 or the second axis X2 of the hollow rectangular steel frame 10.

In the embodiments shown in FIGS. 1A and 1B, the beam-column joint structure 1 comprises a first steel plate 15 fixed in and near the top of the hollow rectangular steel frame 10 and a second steel plate 16 fixed in and near the bottom of the hollow rectangular steel frame 10. The first steel plate 15 and the second steel plate 16 have openings 17 in their centers wherein each of the first steel plate 15 and the second steel plate 16 has notches 18 at four corners thereof. In operation, concrete is grouted into the hollow rectangular steel frame 10 through the opening 17 of the first steel plate 15 and concrete may be filled between the beam-column joint structure 1 and the precast RC column 4 (see FIGS. 5-7) through the opening 17 of second steel plate 16. The notches 18 of the first steel plate 15 and the second steel plate 16 are for air to be expelled out of the hollow rectangular steel frame 10 when concrete is grouted into the hollow rectangular steel frame 10 through the opening 17 of the first steel plate 15 so that the concrete would contain less air when the concrete reaches its final set.

Figure 2:
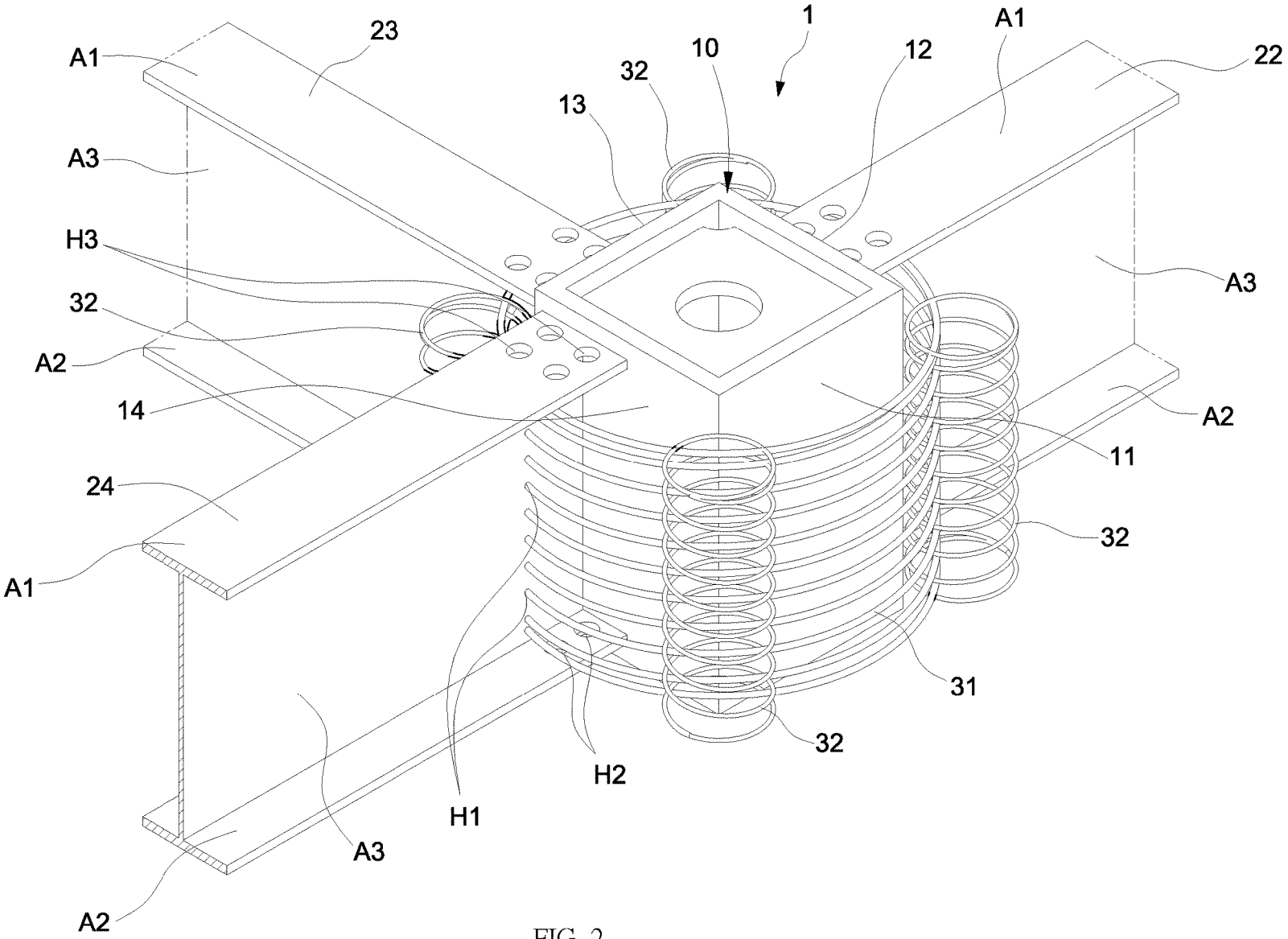
FIG. 2 is a perspective schematic view showing a beam-column joint structure in accordance with a further embodiment of the instant disclosure.

In another embodiment of the instant disclosure, some of the outer surfaces of the sidewalls of the hollow rectangular steel frame 10 are provided with H-beams whereas the others are not. As shown in FIG. 2, the first sidewall 11 of the hollow rectangular steel frame 10 is not provided with an H-beam, whereas each of the second sidewall 12, the third sidewall 13 and the fourth sidewall 14 is provided with one H-beam 22, 23, 24. In addition, the central axes along the lengthwise direction of the plurality of H-beams 22, 23, 24 are not aligned with the first axis X1 or the second axis X2 of the hollow rectangular steel frame 10. That is, the H-beams in the embodiment of FIG. 2 are asymmetrical with respect to the hollow rectangular steel frame 10.

Figure 3:
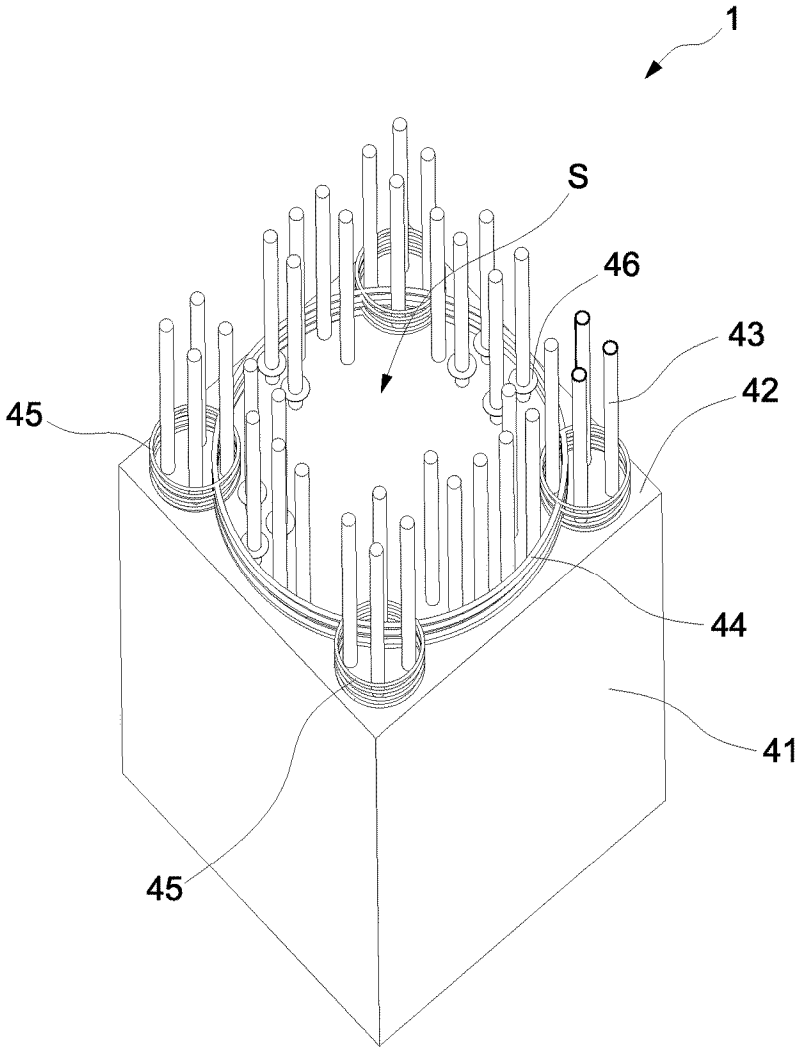
FIG. 3 is a perspective schematic view showing a precast RC column with connecting rebars extending from its top in accordance with the further embodiment of the instant disclosure.

FIGS. 4-7 are schematic views showing the processes that the beam-column joint structure 1 shown in FIG. 2 is assembled with the precast RC column shown in FIG. 3 and then the assembled structure is covered with concrete. As shown in FIG. 2, each of the three H-beams 22, 23, 24 contains a column of holes H1 in the webs A3 of the H-beams 22, 23, 24. The column of holes H1 is disposed along the heights of the webs A3 of the H-beams 22, 23, 24. A first main spiral stirrup 31 passes through the webs A3 of the H-beams 22, 23, 24 via the columns of the holes H1 and is disposed between the top flanges A1 and the bottom flanges A2 of the plurality of H-beams 22, 23, 24. Four first auxiliary spiral stirrups 32 are disposed at the circumferences of the first main spiral stirrup 31 and overlap a portion of the first main spiral stirrup 31. The hollow rectangular steel frame 10 is disposed within the first main spiral stirrup 31 and the four first auxiliary spiral stirrups 32 are located near the four outer corners of the hollow rectangular steel frame 10.

Please refer to FIG. 3. The precast RC column 4 comprises a precast body 41 with connecting rebars 43 extending from its top surface 42. These connecting rebars 43 are generally distributed near the circumference of the top surface 42 and form a space S therein. The size of the space S should be sufficient for accommodating an end of the hollow rectangular steel frame 10 as shown in FIG. 2. Furthermore, a second main spiral stirrup 44 is provided to surround some of the connecting rebars 43; four second auxiliary spiral stirrups 45 are provided near the four top corners of the precast body 41 and surround the connecting rebars 43 provided at the four top corners of the precast body 41. The four second auxiliary spiral stirrups 45 overlap several portions of the second main spiral stirrup 44 and thereby some connecting rebars 43 are surrounded by both the second main spiral stirrup 44 and the four second auxiliary spiral stirrups 45. Each of the second main spiral stirrup 44 and the four second auxiliary spiral stirrups 45 in FIG. 3 has three coils. In other embodiments, each of the second main spiral stirrup 44 and the four second auxiliary spiral stirrups 45 has a different number of coils. The actual number of coils would depend on the actual design requirements.

As shown in FIG. 3, for some of those connecting rebars 43 that will be inserted into the bottom flanges A2 of the H-beams 22, 23, 24 when the beam-column joint structure 1 is to be assembled with the precast RC column 4, adjusters 46 are sleeved on these connecting rebars 43 beforehand. These adjusters 46 on the connecting rebars 43 are moveable along the lengthwise direction of the connecting rebars 43 and are arranged to abut against the bottoms of the bottom flanges of the H-beams 22, 23, 24 for adjusting the levels of the H-beams 22, 23, 24. These adjusters 46 in FIG. 3 are ring-shaped.

Figure 4:
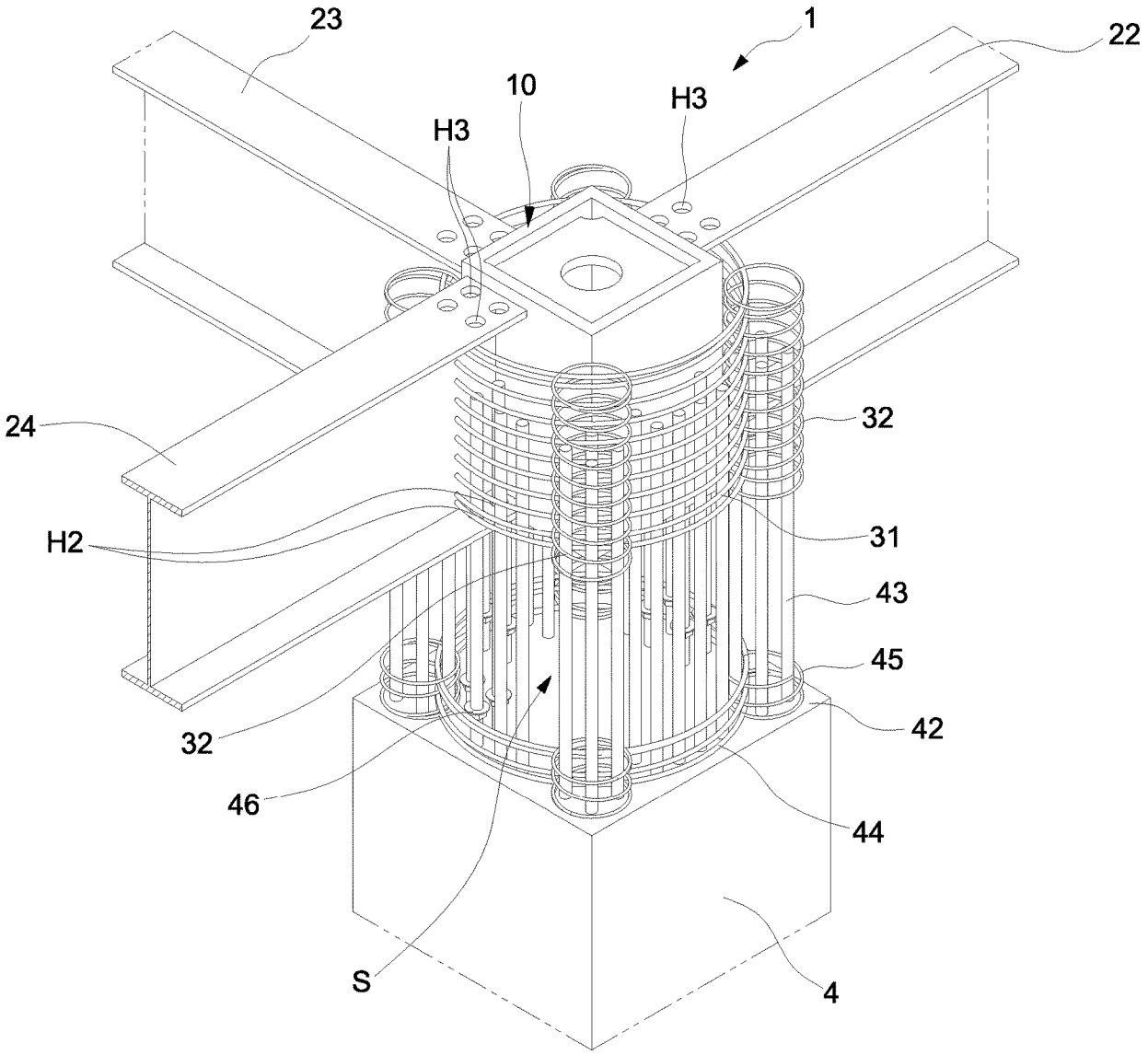
FIG. 4 is a schematic view showing the beam-column joint structure to be connected with the precast RC column in accordance with the further embodiment of the instant disclosure.

Please refer to FIG. 4, which shows the beam-column joint structure 1 is about to be connected with the precast RC column 4. The adjusters 46 on the connecting rebars 43 are moved along the connecting rebars 43 to the predetermined heights. The beam-column joint structure 1 is hoisted by a hoister (not shown) above the precast RC column 4 so that the holes H2 in the bottom flanges A2 of the H-beams 22, 23, 24 are aligned with the corresponding connecting rebars 43 extending from the top surface 42 of the precast RC column 4 and the bottom of the hollow rectangular steel frame 10 corresponds to the space S surrounded by the connecting rebars 43. In addition, the four first auxiliary spiral stirrups 32 surround the connecting rebars 43 provided at the four top corners of the precast body 41 and the first main spiral stirrup 31 surrounds the rest of the connecting rebars 43 when the beam-column joint structure 1 is descended by the hoister toward the precast RC column 4. As shown in FIG. 3, some of the connecting rebars 43 may be surrounded by both the first main spiral stirrup 31 and the first auxiliary spiral stirrups 32. Furthermore, in the vertical direction, the first main spiral stirrup 31 of the beam-column joint structure 1 is aligned with and arranged to be connected to the second main spiral stirrup 44 of the precast RC column 4, and the four first auxiliary spiral stirrups 32 of the beam-column joint structure 1 are respectively aligned with and arranged to be connected to the four second auxiliary spiral stirrups 45 of the precast RC column 4.

Figure 5:
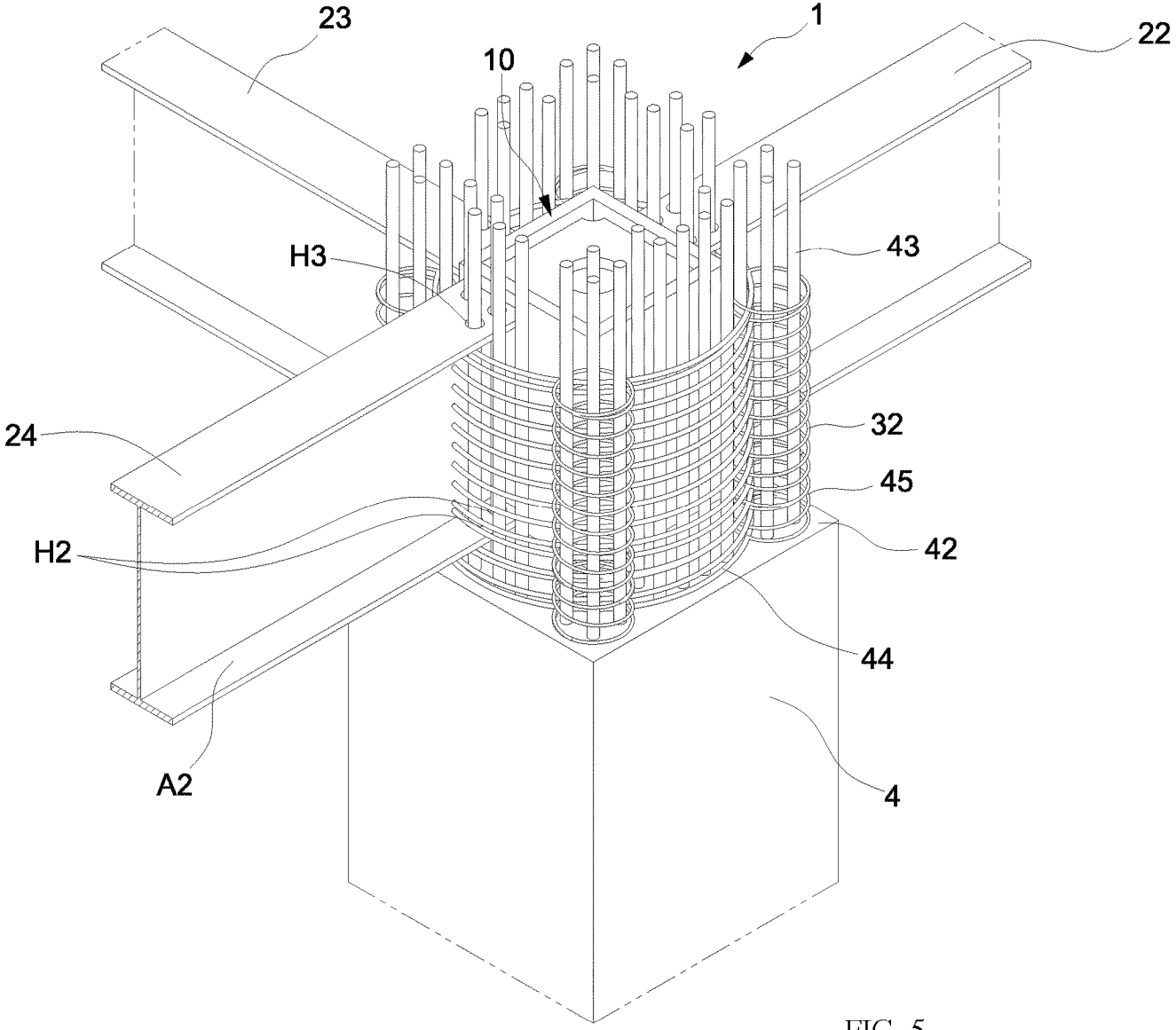
FIG. 5 is a perspective schematic view showing the beam-column joint structure connected with the precast RC column in accordance with the further embodiment of the instant disclosure.

During the process in which the beam-column joint structure 1 is descended by the hoister to be assembled with the precast RC column 4, the pertinent connecting rebars 43 are first inserted into the holes H2 in the bottom flanges A2 of the H-beams 22, 23, 24 and then these connecting rebars 43 are further inserted into the holes H3 in the top flanges A1 of the H-beams 22, 23, 24 (see FIG. 5). The beam-column joint structure 1 will be descended until the bottom of the bottom flanges A2 abuts against the adjusters 46 on the connecting rebars 43 of the precast RC column 4 so that the beam-column joint structure 1 is placed at a predetermined height.

Figure 6:
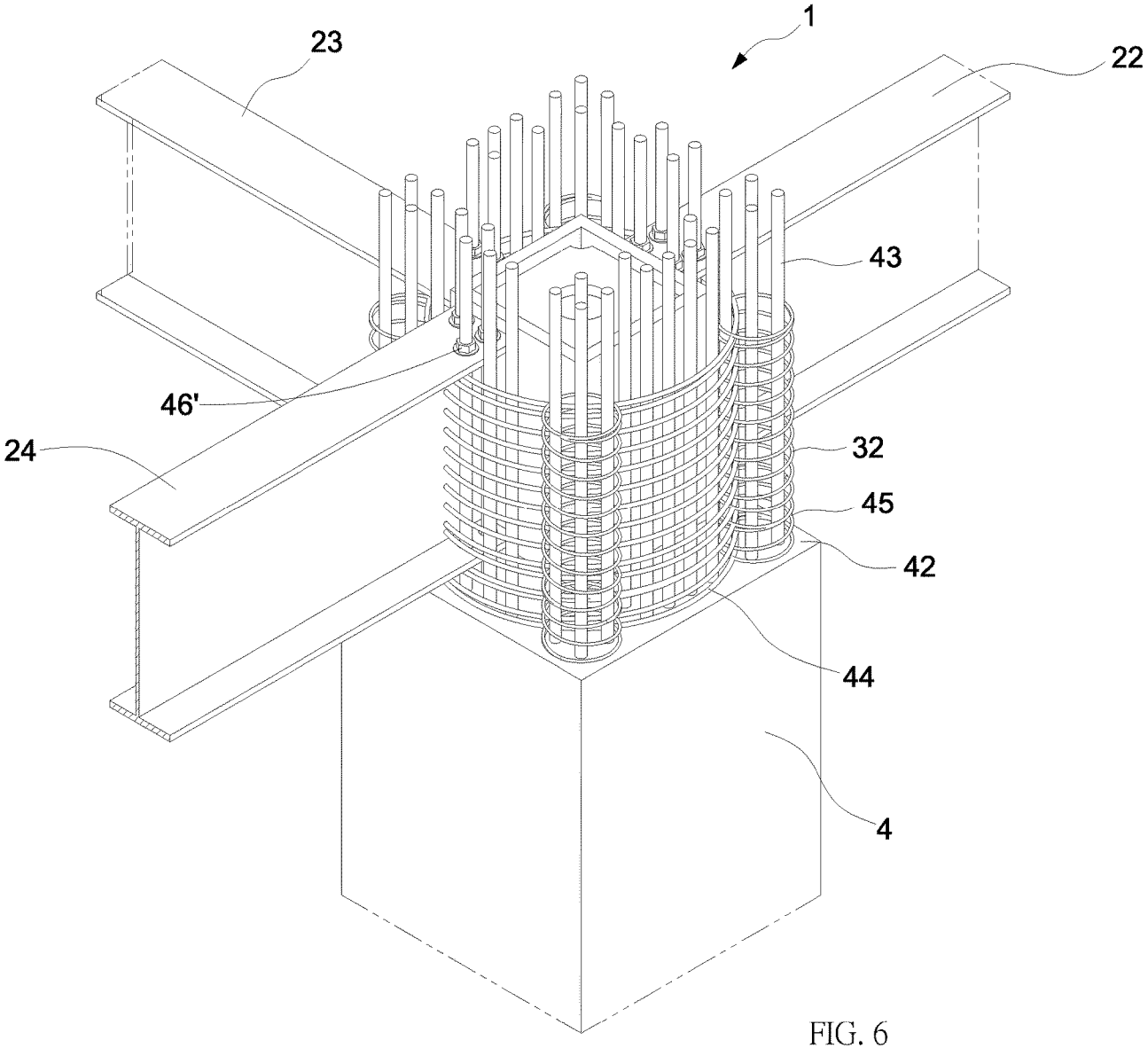
FIG. 6 is another perspective schematic view showing the beam-column joint structure connected with the precast RC column in accordance with the further embodiment of the instant disclosure.
Figure 7:
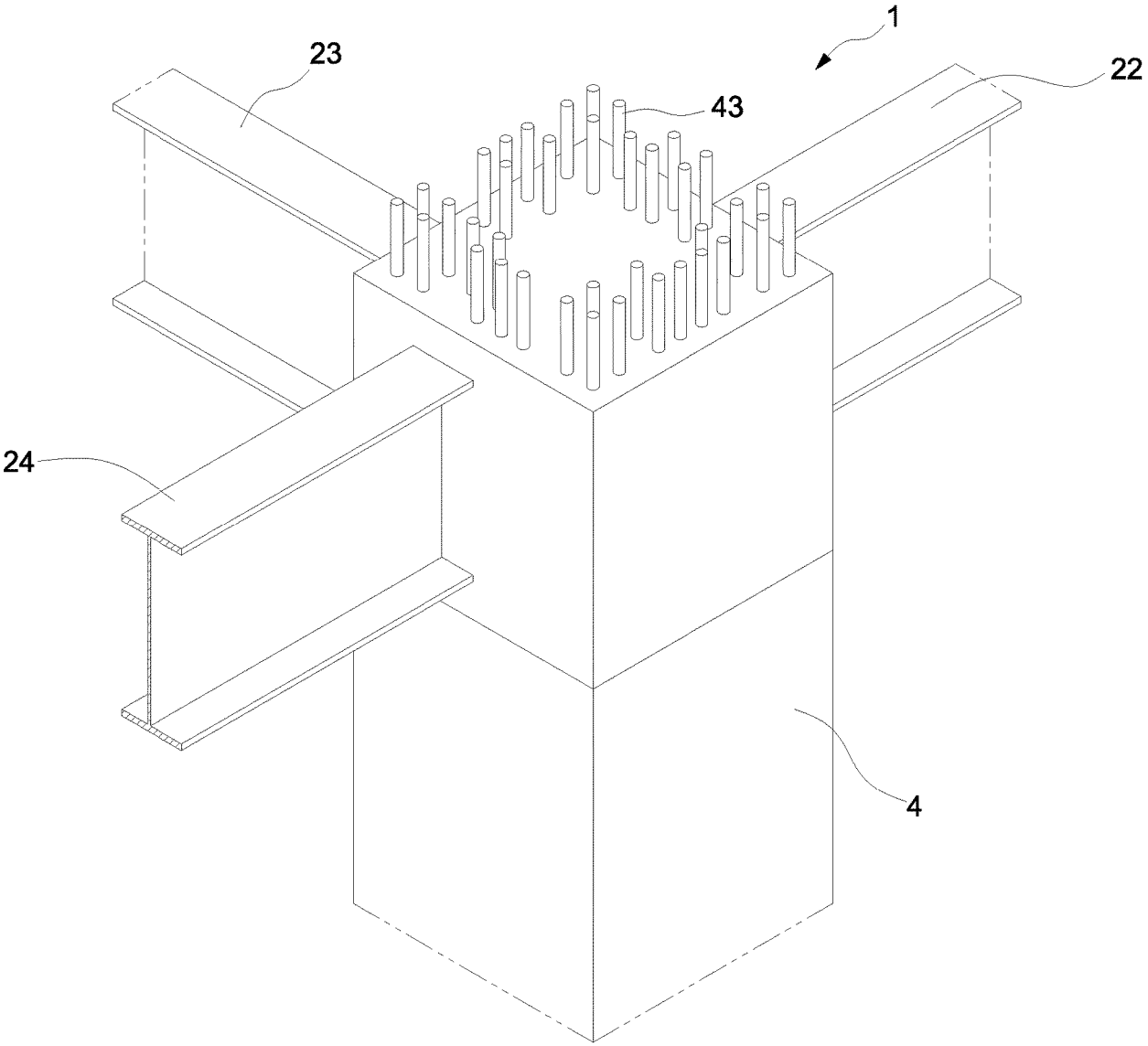
FIG. 7 is a schematic view showing the beam-column joint structure connected with the precast RC column with concrete covering the stirrups of the beam-column joint structure and those on the top of precast RC column in accordance with the further embodiment of the instant disclosure.

As shown in FIG. 6, when the beam-column joint structure 1 has been placed at a predetermined height, the ends of the pertinent connecting rebars 43 are exposed from the top flanges A1 of the H-beams 22, 23, 24. Thereafter, fasteners 46' are sleeved on the ends of the pertinent connecting rebars 43 and are rotated or moved to abut against the top surface of the top flanges A1 of the H-beams 22, 23, 24. Then, formworks (not shown) are provided to seal the space above the precast RC column 4 and around the beam-column joint structure 1 for concrete grouting. After the concrete has reached its initial set or final set, the formworks are removed and the finished construction is as shown in FIG. 7.

Figure 8:
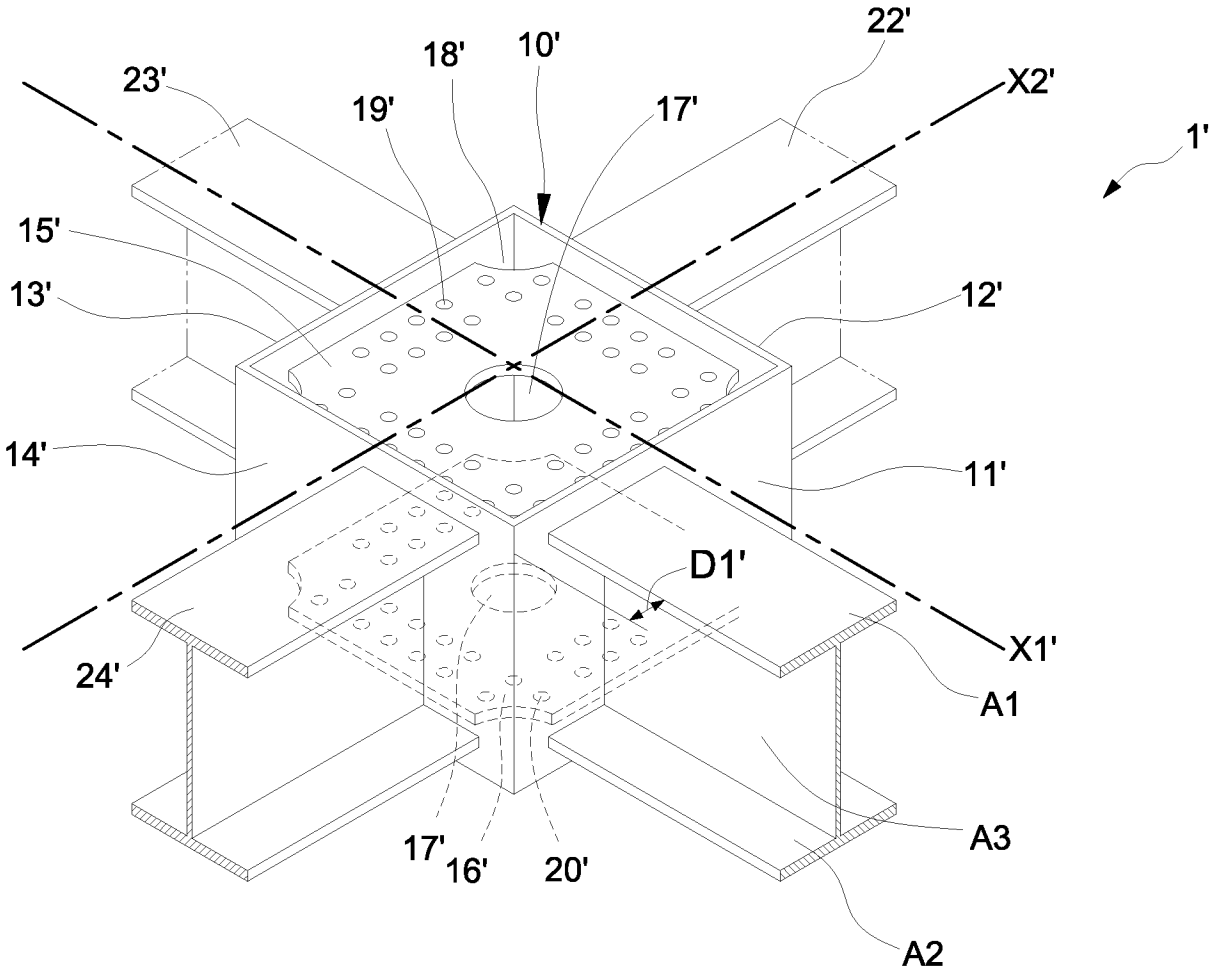
FIG. 8 is a schematic view showing a beam-column joint structure in accordance with a still further embodiment of the instant disclosure.

FIG. 8 is a schematic view showing a beam-column joint structure 1' in accordance with another embodiment of the instant disclosure. The beam-column joint structure 1' comprises a first steel plate 15' fixed in and near the top of the hollow rectangular steel frame 10' and a second steel plate 16' fixed in and near the bottom of the hollow rectangular steel frame 10'. The first steel plate 15' and the second steel plate 16' have openings 17' in their centers wherein each of the first steel plate 15' and the second steel plate 16' has notches 18' at four corners thereof. In operation, concrete is grouted into the hollow rectangular steel frame 10' through the opening 17' of the first steel plate 15' and concrete may be filled between the beam-column joint structure 1 and the precast RC column 4 (see FIGS. 10-12) through the opening 17' of second steel plate 16'. The notches 18' of the first steel plate 15' and the second steel plate 16' are for air to be expelled out of the hollow rectangular steel frame 10 ‘ when concrete is grouted into the hollow rectangular steel frame 10 through the opening 17’ of the first steel plate 15' so that the concrete would contain less air when the concrete reaches its final set. As shown in FIG. 8, the first steel plate 15' comprises a plurality of first through holes 19' therein and the second steel plate 16' comprises a plurality of second through holes 20' therein, and the plurality of first through holes 19' are generally aligned with the plurality of second through holes 20' for connecting rebars 43 (see FIG. 10) of the precast RC column 4 to pass through.

Figure 9:
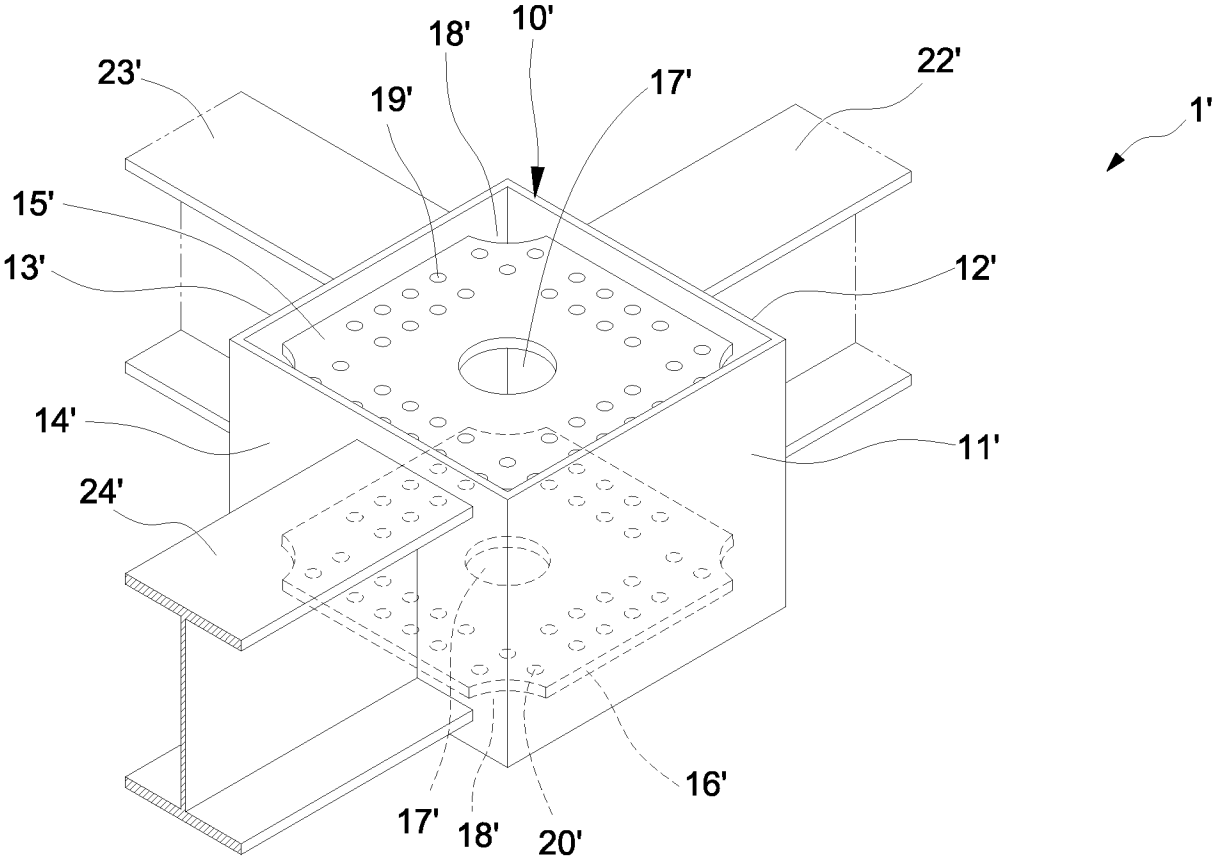
FIG. 9 is a schematic view showing a beam-column joint structure in accordance with a still further embodiment of the instant disclosure.

FIG. 9 is a schematic view showing a beam-column joint structure 1' in accordance with a further embodiment of the instant disclosure. As shown in FIG. 9, the first sidewall 11' of the hollow rectangular steel frame 10' is not provided with an H-beam, whereas each of the second sidewall 12', the third sidewall 13' and the fourth sidewall 14' is provided with one H-beam 22', 23', 24'. In addition, the central axes along the lengthwise direction of the plurality of H-beams 22', 23', 24' are not aligned with the first axis X1 (not shown) or the second axis X2 (not shown) of the hollow rectangular steel frame 10'. That is, the H-beams in the embodiment of FIG. 10 are asymmetrical with respect to the hollow rectangular steel frame 10'.

Figure 10:
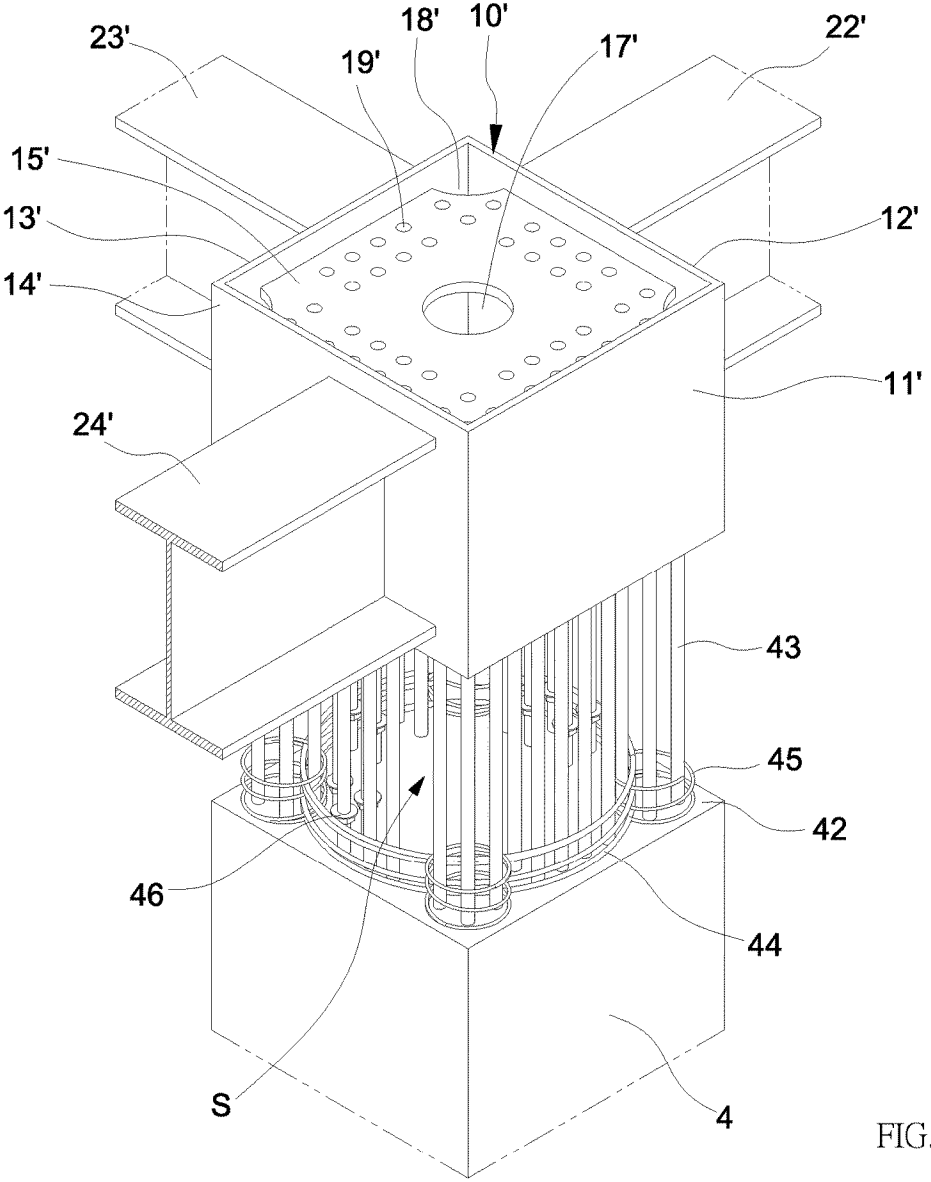
FIG. 10 is a schematic view showing the beam-column joint structure in FIG. 9 to be assembled with the precast RC column in FIG. 3.
Figure 11:
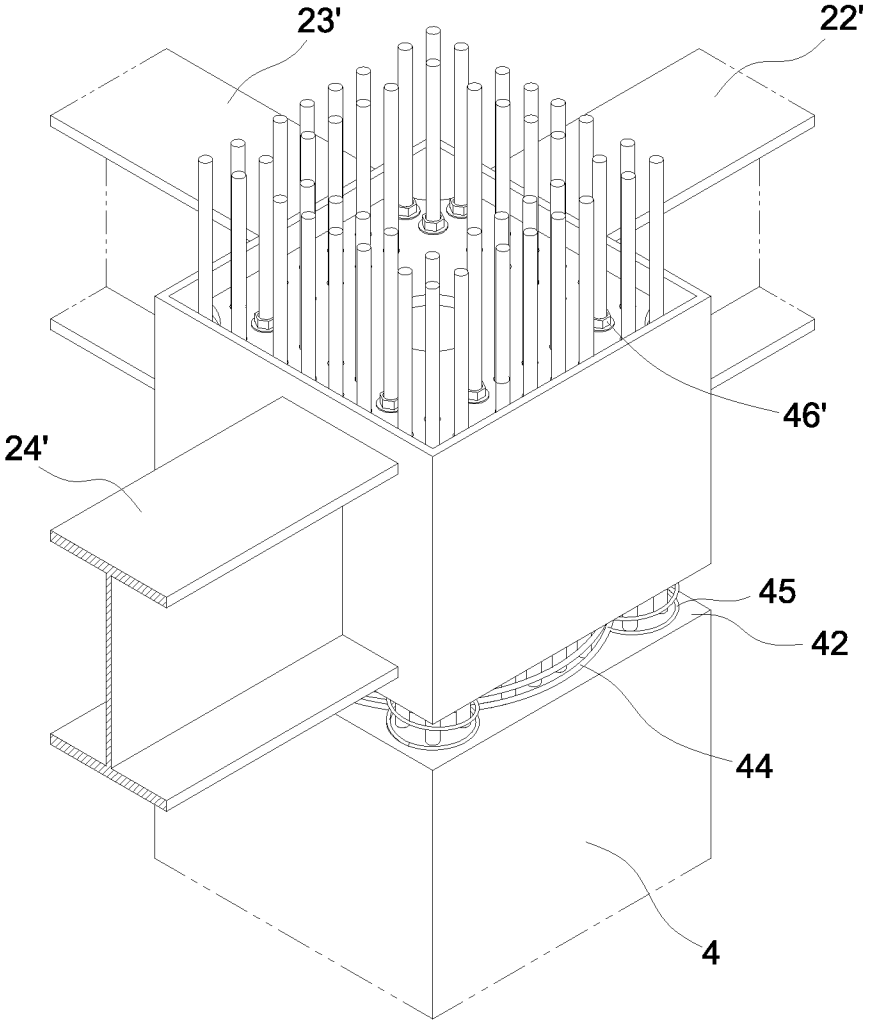
FIG. 11 is another schematic view showing the beam-column joint structure in FIG. 9 to be assembled with the precast RC column in FIG. 3.
Figure 12:
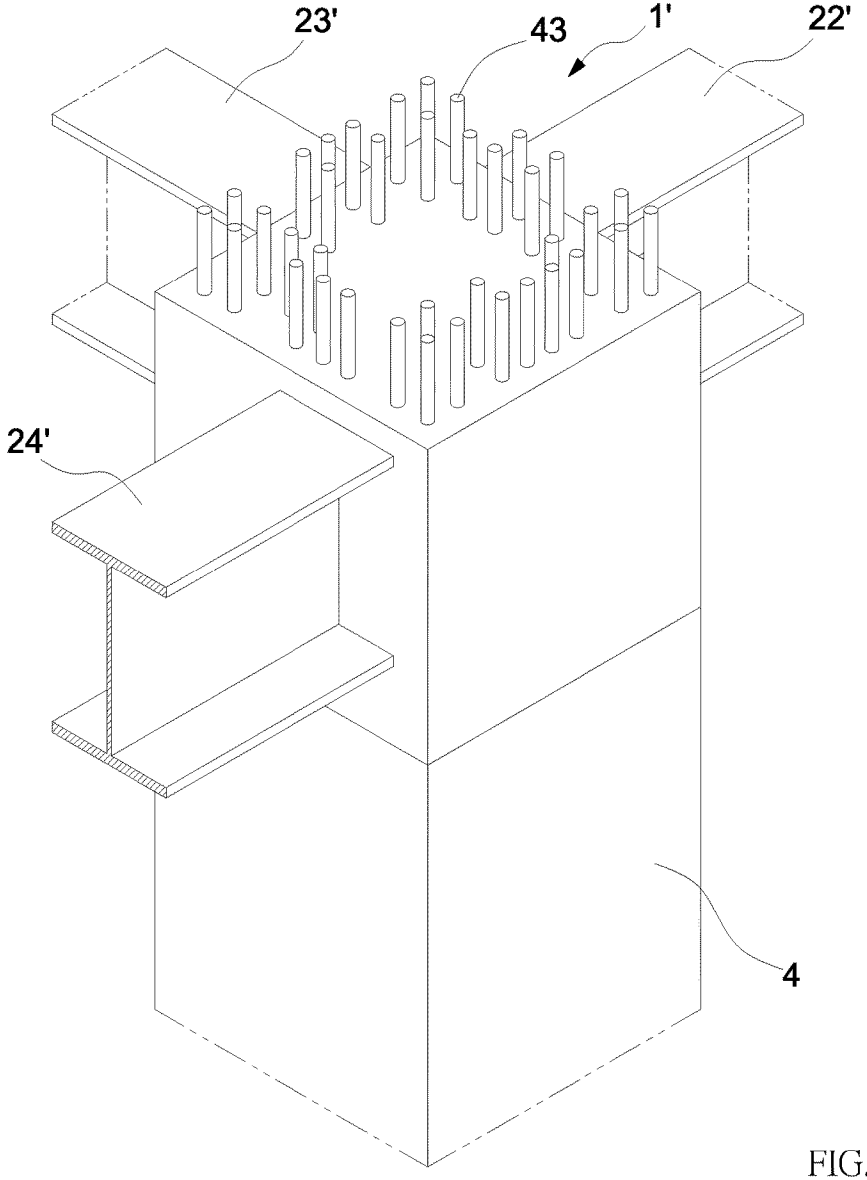
FIG. 12 is a schematic view showing the beam-column joint structure in FIG. 9 assembled with the precast RC column in FIG. 3 with concrete covering the stirrups of the beam-column joint structure and those on the top of precast RC column.

FIGS. 10-12 are schematic views showing the processes that the beam-column joint structure 1' shown in FIG. 9 is assembled with the precast RC column shown in FIG. 3 and then the assembled structure is covered with concrete. As shown in FIG. 10, the width and the length of the hollow rectangular steel frame 10' are smaller than those of the precast RC column 4. When the beam-column joint structure 1' is hoisted by a hoister (not shown) above the precast RC column 4, the connecting rebars 43 extending from the top of the precast RC column 4 are aligned with the plurality of the first through holes 19' of the first steel plate 15' and the plurality of the second through holes 20' of the second steel plate 16'.

As shown in FIG. 11, when the beam-column joint structure 1' is descended by the hoister (not shown), the connecting rebars 43 extending from the top of the precast RC column 4 are inserted into the second through holes 20' of the second steel plate 16' and then the ends of the connecting rebars 43 are inserted into and exposed from the first through holes 19' of the first steel plate 15'.

The beam-column joint structure 1' will be descended by the hoister (not shown) until the bottom of the second steel plate 16' abuts against the adjusters 46 on the connecting rebars 43 of the precast RC column 4 so that the beam-column joint structure 1' is placed at a predetermined height.

Thereafter, fasteners 46' are sleeved on the ends of the pertinent connecting rebars 43 and are rotated or moved to abut against the top surface of the first steel plate 15'. Then, formworks (not shown) are provided to seal the space above the precast RC column 4 and around the beam-column joint structure 1 for concrete grouting. After the concrete has reached its initial set or final set, the formworks are removed and the finished construction is as shown in FIG. 12.

As shown in FIGS. 9-12, no stirrups are provided around the outer circumference of the hollow rectangular steel frame 10'. This is because in the embodiment shown in FIGS. 9-12, the vertically positioned connecting rebars 43 are all confined within the hollow rectangular steel frame 10' and are fixed to the first steel plate 15' and the second steel plate 16'. That is, the first sidewall 11', the second sidewall 12', the third sidewall 13' and the fourth sidewall 14' of the hollow rectangular steel frame 10' serve the same function as stirrups for confining the connecting rebars 43 and the concrete therein.

In alternative embodiments, the beam-column joint structure 1 according to FIGS. 2-7 or the beam-column joint structure 1' according to FIGS. 9-12 may be assembled with concrete columns made on site. That is, the concrete columns are not limited to precast RC columns in the instant disclosure. In addition, the H-beams in these embodiments may be replaced with steel beams of different shapes, such as I-beam, C-beam, T-beam etc.

The above embodiments merely describe the principle and effects of the present disclosure, instead of limiting the present disclosure. Therefore, persons skilled in the art can make modifications to and variations of the above embodiments without departing from the spirit of the present disclosure. The scope of the present disclosure should be construed as that defined by the appended claims.

What is claimed is:

1. A construction, comprising:

a beam-column joint structure comprising:

a hollow rectangular steel frame consisting of a first sidewall, a second sidewall, a third sidewall and a fourth sidewall, wherein the first sidewall is arranged opposed to the third sidewall, and the second sidewall is arranged opposed to the fourth sidewall;

a plurality of H-beams, wherein each of the plurality of H-beams is fixedly attached to an outer surface of at least some of the first sidewall, the second sidewall, the third side wall and the fourth sidewall; and a first steel plate fixed in and near the top of the hollow rectangular steel frame and a second steel plate fixed in and near the bottom of the hollow rectangular steel frame;

wherein a first axis is defined by a central position of the first sidewall and a central position of the third sidewall;

wherein a second axis is defined by a central position of the second sidewall and a central position of the fourth sidewall;

wherein at least one of the plurality of H-beams is offset from the first axis in the transverse direction of the first sidewall or the third sidewall;

wherein at least one of the plurality of H-beams is offset from the second axis in the transverse direction of the second sidewall or the fourth sidewall; and wherein the first steel plate comprises a plurality of first through holes therein and the second steel plate comprises a plurality of second through holes therein and wherein the plurality of first through holes are generally aligned with the plurality of second through holes for rebars to pass through; and a precast reinforced concrete (RC) column comprising a precast body with the rebars extending from the top surface;

wherein the rebars are generally distributed near the circumference of the top surface and form a space therein and wherein the size of the space is sufficient for accommodating an end of the hollow rectangular steel frame;

wherein the precast RC column further comprises a second main spiral stirrup provided to surround some of the rebars and four second auxiliary spiral stirrups provided near four top corners of the precast body and surrounding the rebars provided at the four top corners of the precast body.

2. The construction according to claim 1, wherein no stirrups are provided around an outer circumference of the hollow rectangular steel frame.

3. The construction according to claim 1, wherein the first steel plate has a first opening in its center and the second steel plate has a second opening in its center, and the diameter of the first opening is the same as that of the second opening and is larger than that of the plurality of first through holes and that of the plurality of second through holes.

4. The construction according to claim 3, wherein each of the first steel plate and the second steel plate has notches at four corners thereof.

5. The construction according to claim 1, wherein flanges of the plurality of H-beams do not contain any through holes.

6. The construction according to claim 1, wherein each of the plurality of H-beams contains a column of holes therein, the column of holes being disposed along the heights of webs of the H-beams, the beam-column joint structure further comprising:

a first main spiral stirrup, passing through the webs of the H-beams via the columns of the holes and disposed between top flanges and bottom flanges of the plurality of H-beams; and a plurality of first auxiliary spiral stirrups, disposed at the circumferences of the first main spiral stirrup and overlapping several portions of the first main spiral stirrup;

wherein the hollow rectangular steel frame is provided within the first main spiral stirrup and the plurality of the first auxiliary spiral stirrups are disposed outside of the hollow rectangular steel frame.

7. The construction according to claim 6, wherein the top flanges and the bottom flanges of the plurality of H-beams contain a plurality of through holes therein for rebars to pass through.

8. The construction according to claim 6, wherein the first steel plate has a first opening in its center and the second steel plate has a second opening in its center, and the diameter of the first opening is the same as that of the second opening and is larger than that of the plurality of first through holes and that of the plurality of second through holes.

9. The construction according to claim 8, wherein each of the first steel plate and the second steel plate has notches at four corners thereof.

10. The construction according to claim 1, wherein the plurality of H-beams comprises a first H-beam attached to an outer surface of the first sidewall, a second H-beam attached to an outer surface of the second sidewall, and a third H-beam attached to an outer surface of the third side wall and wherein the fourth sidewall has no H-beams attached thereto.

11. The construction according to claim 1, wherein the four second auxiliary spiral stirrups overlap several portions of the second main spiral stirrup and thereby some rebars are surrounded by both the second main spiral stirrup and the four second auxiliary spiral stirrups.

12. The construction according to claim 11, wherein each of the second main spiral stirrup and the four second auxiliary spiral stirrups has three coils.

* * * * *